United States Patent [19]

Rytand

[11] Patent Number: 4,940,021

[45] Date of Patent: Jul. 10, 1990

[54] FLOATING DOCK

[76] Inventor: David H. Rytand, 2402 Killarney Way, S.E., Bellevue, Wash. 98004

[21] Appl. No.: 344,663

[22] Filed: May 30, 1989

Related U.S. Application Data

[63] Continuation of Ser. No. 106,150, Oct. 8, 1987, Pat. No. 4,887,654, which is a continuation-in-part of Ser. No. 816,204, Jan. 6, 1986, Pat. No. 4,709,647.

[30] Foreign Application Priority Data

Oct. 15, 1986 [NZ] New Zealand ..... 217943

[51] Int. Cl.[5] ..... B63B 35/38

[52] U.S. Cl. ..... 114/267; 114/263; 114/266; 405/219

[58] Field of Search ..... 114/263, 264, 266, 267; 52/223.2, 227, 125.1, 125.4; 405/218–221

[56] References Cited

U.S. PATENT DOCUMENTS

| | | | |
|---|---|---|---|
| D.270,529 | 9/1983 | Thompson | D12/316 |
| 1,900,319 | 3/1933 | Vermeulen | 405/218 |
| 2,879,735 | 3/1959 | Pointer | 114/266 |
| 3,012,533 | 12/1961 | Tellefsen | 114/267 |
| 3,073,271 | 1/1963 | Brill | 114/266 |
| 3,073,274 | 1/1963 | Lamb | 114/266 |
| 3,091,203 | 5/1963 | Usab | 114/266 |
| 3,157,144 | 11/1964 | De Jarnett | 114/267 |
| 3,179,076 | 4/1965 | Sheffield | 114/267 |
| 3,323,479 | 6/1967 | Filak | 114/266 |
| 3,448,709 | 6/1969 | Hardwick, Jr. | 114/266 |
| 3,580,202 | 5/1971 | Thompson | 114/266 |
| 3,659,540 | 5/1972 | Toby et al. | 114/266 |
| 3,789,446 | 2/1974 | Rudelick | 441/39 |
| 3,861,340 | 1/1975 | Clingenpeel | 114/267 |
| 3,951,085 | 4/1976 | Johnson et al. | 114/266 |
| 3,977,344 | 8/1976 | Holford | 114/263 |
| 4,041,716 | 8/1977 | Thompson | 114/266 |
| 4,223,629 | 9/1980 | Dunlop | 114/263 |
| 4,252,470 | 2/1981 | Sluys | 405/219 |
| 4,260,293 | 4/1981 | Peterson | 405/219 |
| 4,316,426 | 2/1982 | Meeusen | 114/263 |
| 4,318,361 | 3/1982 | Sluys | 114/263 |
| 4,318,362 | 3/1982 | Jung | 114/266 |
| 4,353,320 | 10/1982 | Sluys | 114/267 |
| 4,365,577 | 12/1982 | Heinrich | 114/267 |
| 4,365,914 | 12/1982 | Sluys | 405/221 |
| 4,418,634 | 12/1983 | Gerbus | 114/263 |
| 4,538,939 | 9/1985 | Johnson | 405/205 |
| 4,559,891 | 12/1985 | Shorter, Jr. | 114/263 |
| 4,709,647 | 12/1987 | Rytand | 114/267 |
| 4,715,307 | 12/1987 | Thompson | 114/65 A |

FOREIGN PATENT DOCUMENTS

| | | | |
|---|---|---|---|
| 800802 | 12/1968 | Canada | 114/263 |
| 2055703 | 3/1981 | United Kingdom | 114/267 |

*Primary Examiner*—Joseph F. Peters, Jr.
*Assistant Examiner*—Clifford T. Bartz
*Attorney, Agent, or Firm*—Klarquist, Sparkman, Campbell, Leigh & Whinston

[57] ABSTRACT

A floating dock includes a plurality of float modules comprised of containers having opposing walls, a deck with opposing edges mounted in spaced relationship above the float modules, and a pair of wales extending along opposing walls of the float modules and opposing edges of the deck. Compression rods extend between the wales and act on the pair of wales such that the compression rods exert compression force on the float modules and deck. A compression beam or plywood panel extends between the opposing walls of the container below the compression rod to create a box beam in combination with the wales and deck, therefore rigidifying the dock to enhance its portability on land and wave resistance properties in water. The float modules are spaced apart longitudinally of the dock to allow wave transparency and wash space for debris. The space between the deck and float modules forms a passageway for utility conduits.

3 Claims, 7 Drawing Sheets

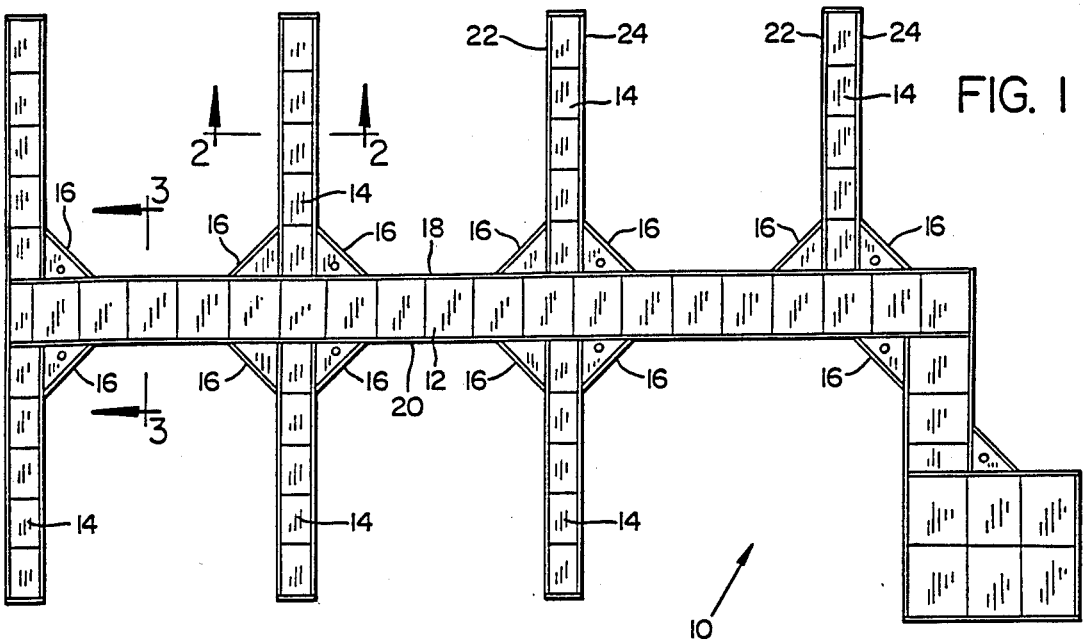
FIG. 1
FIG. 2
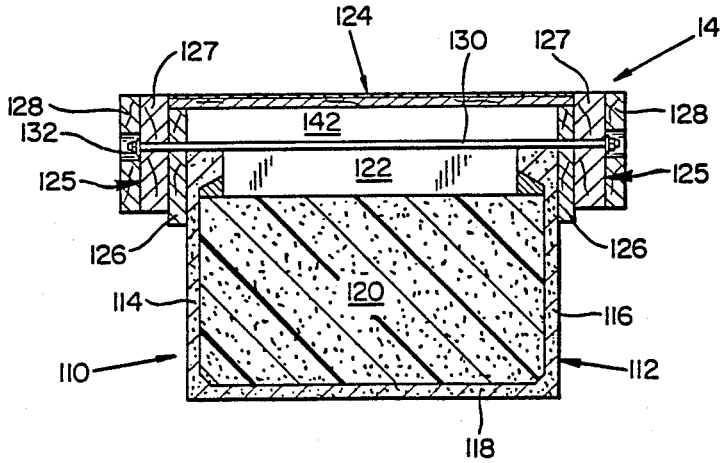
FIG. 3
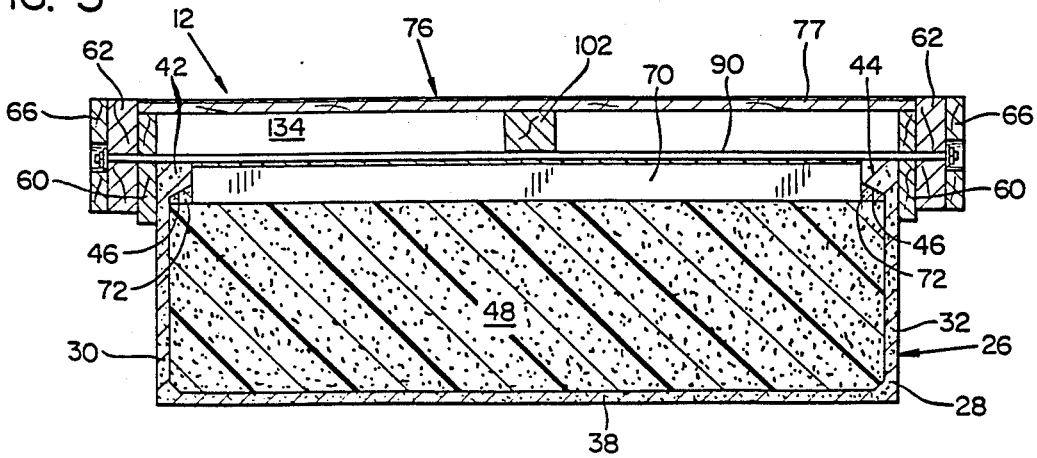

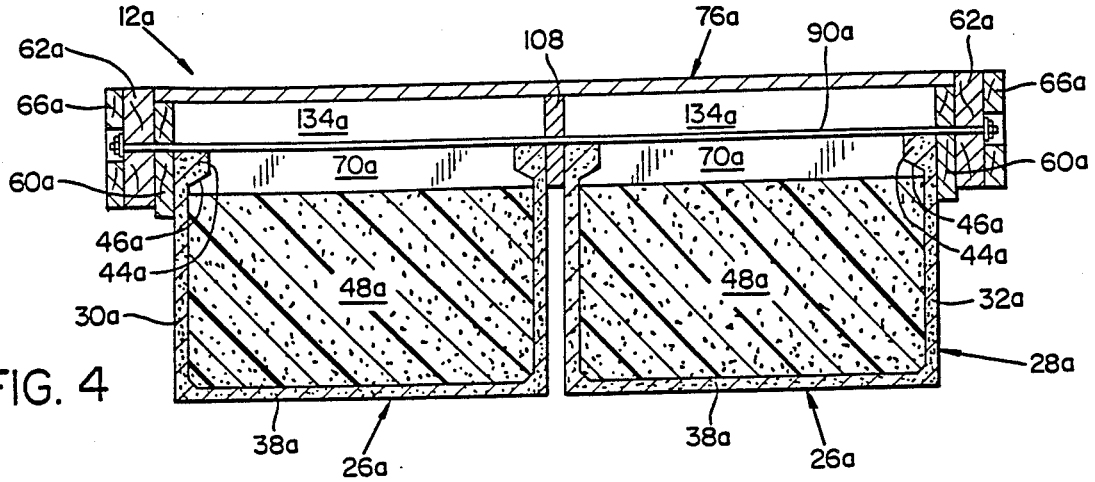
FIG. 4
FIG. 8
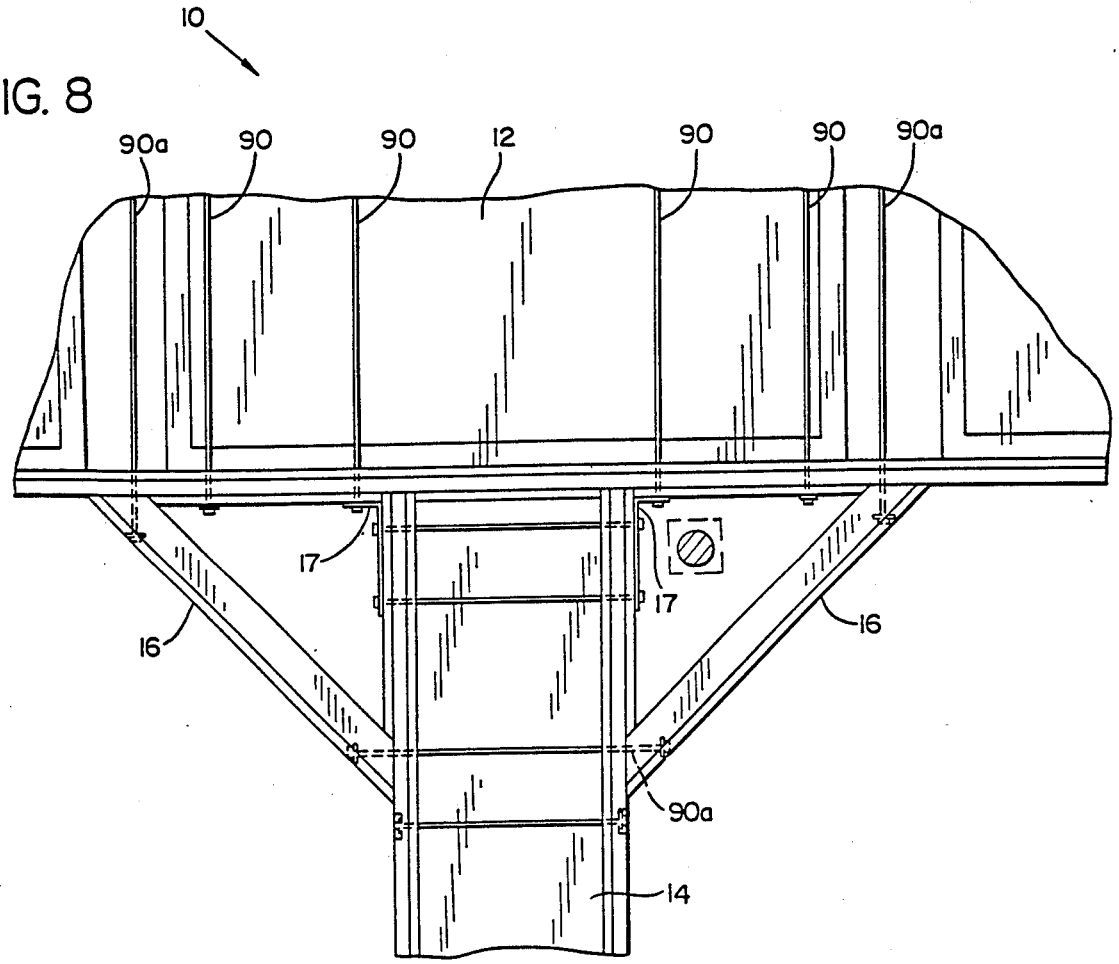

FLOATING DOCKCROSS REFERENCE TO RELATED APPLICATION

This is a continuation of U.S. Application Ser. No. 07/106,150, filed Oct. 5, 1987, now U.S. Pat. No. 4,887,654; issued 12/19/89 which in turn is a continuation-in-part of application 06/816,204, filed Jan. 6, 1986, now U.S. Pat. No. 4,708,647 issued Dec. 1, 1987.

BACKGROUND OF THE INVENTION

1. Field of the Invention

This invention concerns floating docks and is more particularly concerned with floating docks utilizing buoyant floats and having a utility passageway through which utility conduits are routed.

2. General Discussion of the Background

Floating boat docks are commonly constructed by securing a number of rectangular marine floats to each other. Boats are then moored alongside the floats, where it is desirable to provide them with utility services such as electricity, water, sewage, and telephone. Boat docks which supply such services have already been developed.

For example, U.S. Pat. No. 4,353,320 discloses a dock utilizing a marine float having a concrete casing completely surrounding a core of buoyant foam. A utility trench extends longitudinally along the float. One or more compression rods interconnect each longitudinal wall of the float to compressively load the float and enhance its strength. All of the dock's freeboard must also be provided by the float itself, therefore requiring a large, heavy concrete casing that has sufficient displacement to hold the deck of the float out of the water. Finally, the dock is structurally weak at the center of the deck because of the presence of the longitudinal trench in the float.

U.S. Pat. No. 4,318,362 shows a floating concrete dock having a deck portion with a plurality of buoyant floats immediately beneath the deck. The docks are cast with prestressed tendons extending longitudinally to maintain it under longitudinal compression.

U.S. Pat. Nos. 3,073,274 and 4,316,426 both disclose floating docks having decks spaced above floating members. Neither of these structures, however, place the floats and deck under horizontal compression. Absence of such compression allows the dock to bend under the influence of wave forces, eccentric or cantilever loads, and other influences.

Prior art docks have been made out of many materials, such as concrete and plastic. Although plastic components are resistant to salt water deterioration and are easy to manufacture, transport and assemble, they have not been widely accepted for use in dock construction. An example of such a prior art dock using plastic modules is the Thompson Anti-Twist Float manufactured by Thompson Floatation Inc. The Thompson dock includes a plurality of plastic modules each having a continuous, horizontal peripheral flange around an open top of the float. The float has a closed bottom and is filled with buoyant foam which is covered by a protective board. Each module is connected to the dock by placing a plurality of lag screws through the flange into a deck structure. Water leaks into the module through the joint between the deck and horizontal flange, which reduces freeboard of the dock. It is also difficult to provide ballast for the dock since any heavy material within the plastic module will increase its weight and tend to tear out the screws which secure the module to the deck.

U.S. Pat. Nos. 3,448,709 and 4,559,891 disclose docks having plastic floats and tie bars through the decks. Since the deck is molded on the float, no space is provided through which utility lines may pass. Moreover, a peripheral flange of the module in the '891 patent is subject to direct vertical tension which tends to tear the flange.

U.S. Pat. Nos. 3,179,076 and 4,041,716 also disclose docks having plastic modules, but the tie bars in these patents extend through vertical walls of the module below the deck. Ballasting such modules places a direct vertical tension on the module which risks tearing the unit.

It is accordingly an object of this invention to provide an improved floating dock having a utility passageway through which utility conduits may be placed.

Another object of the invention is to provide a dock which can be compressively loaded to enhance its strength and resistance to wave action.

Yet another object of the invention is to provide a rigidified floating dock which spans waves and can be easily transported.

Still another object of the invention is to provide a dock in which nails, screws, or other fasteners cannot work their way above the surface of the deck thereof under torsional forces.

Even yet another object of the invention is to provide a lightweight floating dock having substantial freeboard.

Another object of the invention is to provide a dock that can be easily refurbished, and also to provide a method for refurbishing existing docks.

Yet another object of the invention is to provide a wash space for debris in a floating dock structure.

Another object is to provide a floating dock structure capable of receiving a variety of deck surfaces.

A further object is to provide a floating dock structure wherein utility lines may be positioned in a fully open utility passageway prior to installation of a covering deck.

Another object of this invention to provide a floating dock which resists the corrosive influence of the water in which it is placed.

A further object is to provide a dock having modules which are under horizontal compression without being subject to direct vertical tensions, even when the modules are ballasted.

Even yet another object is to provide such a dock which does not allow unwanted water to seep into the modules.

Finally, it is an object to provide a dock comprised of modules which are easily stackable and liftable.

These and other objects of the invention will be understood more clearly by reference to the following detailed description and drawings.

SUMMARY OF THE INVENTION

In accordance with one illustrated embodiment, certain of the foregoing objects are achieved by providing a floating dock which includes a plurality of aligned float modules each having opposing walls, and an overlapping deck mounted above the float module. The float modules comprise concrete, tub-like containers containing buoyant material such as foamed plastic. A pair of wales extend along the opposing longitudinal walls of the float modules and opposing edges of the deck. In each float module, compression rods extend transversely between and act upon the pair of wales such that the compression rods exert compressive force on both the container and deck. The compression rods are positioned in the space between the deck and float module so as to provide easy access to the rods when replacement becomes necessary.

A plurality of concrete or wood beams extend between opposing walls of each float module, one below each compression rod, and each of the beams is compressively loaded by the rod. The compressively loaded beams in the plurality of modules, in combination with the opposing wales and spaced deck, provide a box beam which imparts great overall rigidity to the dock.

The float modules are spaced apart, providing a series of flow spaces beneath the deck through which debris may be washed. In addition, these spaces provide wave transparency to the dock which enhances its stability. Separation of the modules also reduces damage caused by adjacent modules bumping each other.

A reinforcing bar extends through the walls of the float module enclosure, and a plurality of lifting loops are supported by the reinforcing bar and protrude upwardly from the float module. These loops can be attached to lifting hooks for easy transportation of the float module, for example, movement of the module between a truck and the water.

The deck of the present dock can be held in place on the float modules by the compressive and frictional forces of the wales alone. In some embodiments, however, brackets or other mechanical fasteners are provided to securely hold the deck in place.

A significant advantage of the present structure is that the compressive loading of the modules and connecting wales throughout the length of the dock rigidifies it and increases its strength during transportation and in the marine environment on which it floats. The rigid box beam structure withstands larger waves and heavier cantilever loads than previous structures. This significant increase in strength is obtained while simultaneously desirably increasing freeboard with an elevated deck.

In accordance with another illustrated embodiment, the floating dock includes a plurality of aligned plastic float modules each having opposing sidewalls and aligned, opposing load distributing flexural flanges extending upwardly from the opposing sidewalls. A deck is positioned above the float modules, and a pair of opposing wales extend along and engage the opposing edges of the deck and opposing flanges of the modules. A compression rod extends through the flexural flanges and wales to exert a compressive force on them and clamp the wales against the flanges and deck. In preferred embodiments, a panel of plywood extends across the module below the compression rod such that the deck and plywood panel form a compression beam when the compression rod is compressively loaded. The module also contains a buoyant material such as foamed plastic.

The flexural flange of the module preferably includes an upwardly extending lip connected to the module sidewall by an S-shaped member. The S-shaped member has a downwardly curved shoulder connected to the module sidewall, and an upwardly curved shoulder connected to the upwardly extending lip. Vent holes can be provided through the upwardly curved shoulder to drain out any water that may seep through the junction between the flange and deck.

Ballast can be provided in each module for lowering the metacentric height of the dock and improving its stability. The increased ballast weight of the module will not tear the module away from the dock since the compression rod through the module flanges positively supports the ballasted module. In addition, the module flanges are frictionally engaged by the wales, which further supports the heavy module. The S-shaped configuration of the flange connection provides a flexural member which dampens direct transmission of the load of any ballast to the compression rods. Such dampening is especially advantageous during periods of extreme wave action when subjecting the sidewall to a direct vertical tension could tear the ballasted module along the length of the flange.

Although the module will usually be ballasted by placing a heavy, dense material such as sand within the module, an alternate means for ballasting the dock is provided by placing water ports in or near the bottom of each module. The dock is ballasted by the weight of the water which enters the modules when they are placed in water. This arrangement maintains level flotation of the dock even if water leaks past the flexural flange into the module. Since the water level within the module will always remain the same as the water level outside the module, leakage of water into the module between the flange and deck will not affect level flotation of the dock. The water ballast also eliminates fatigue potential of heavy ballast material on the module since the weight of water within the module is the same as the weight of the surrounding medium. Use of a water ballast also eases assembly of the dock since ballast material does not need to be added. Moreover, the modules will be lighter and can more easily be placed in and lifted out of the water.

BRIEF DESCRIPTION OF THE DRAWINGS

FIG. 1 is a top plan view of a moorage facility employing one embodiment of the floating dock of the present invention.

FIG. 2 is an enlarged cross-sectional view of a finger float section of the dock taken along section line 2—2 of FIG. 1.

FIG. 3 is an enlarged cross-sectional view of a main walk section of the dock taken along section line 3—3 of FIG. 1.

FIG. 4 is a view similar to FIG. 3 showing a second embodiment of the dock in which side-by-side floats are provided in the main walk section.

FIG. 8 is an enlarged, fragmentary top plan view of a connection between the main walk and finger float sections of the dock of FIG. 1, the deck portions of the dock having been removed.

DETAILED DESCRIPTION OF THE PREFERRED EMBODIMENT

Figure 5:
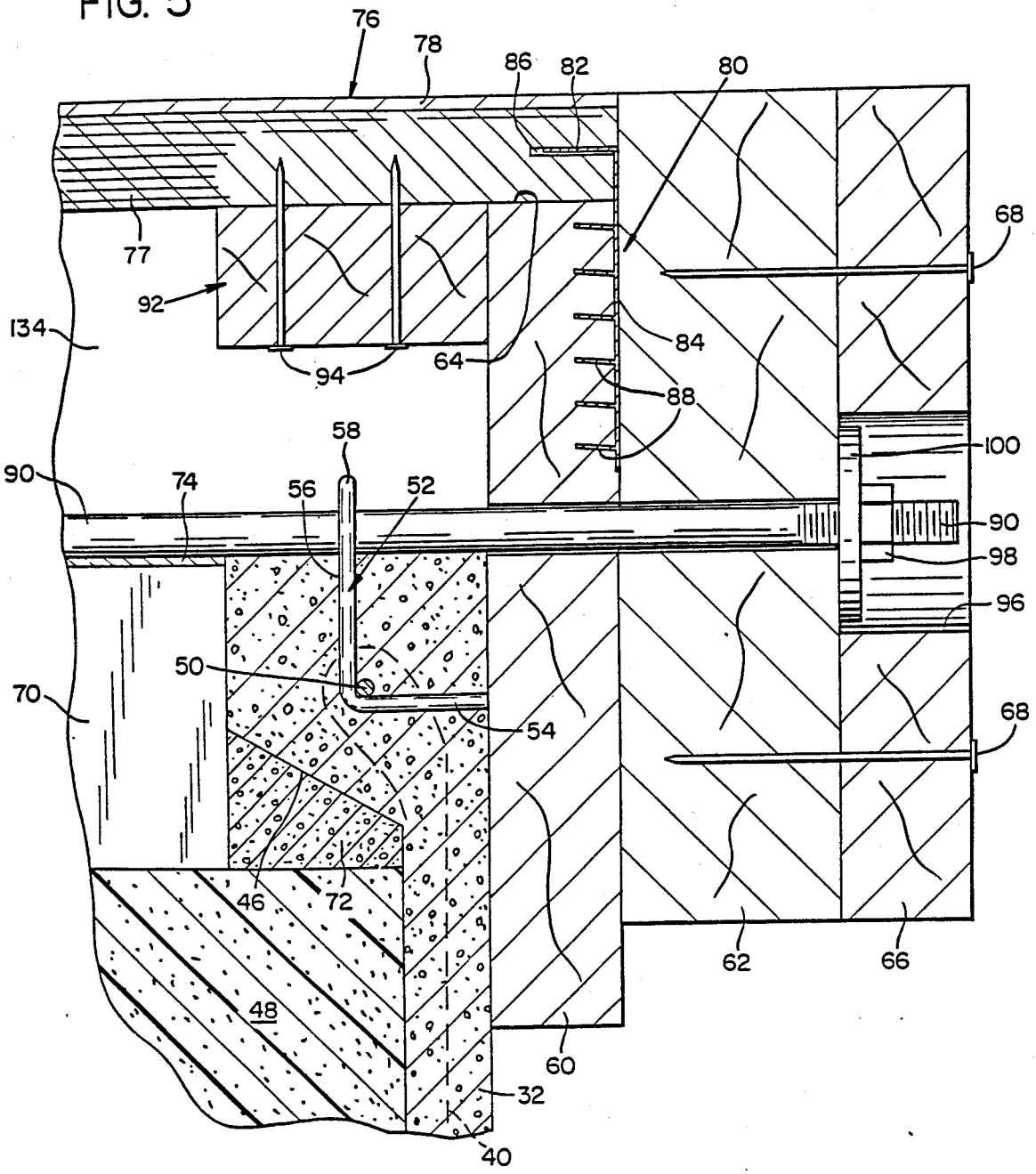
FIG. 5 is an enlarged, fragmentary, sectional view of a top corner of the dock shown in FIG. 3.

Referring first to FIGS. 1 to 3, and FIGS. 5 to 8, the embodiment therein illustrated comprises an elongated floating dock 10 including a main walk section 12 with a plurality of finger float sections 14 extending transversely thereto. Finger sections 14 are attached to the main walk section 12 by a plurality of struts 16 and brackets 17 (FIG. 8) further described below.

Main walk section 12 has opposing sides 18, 20 while finger sections 14 have opposing sides 22, 24. Boats are moored in a conventional manner within the rectangular areas defined between finger sections 14.

Figure 6:
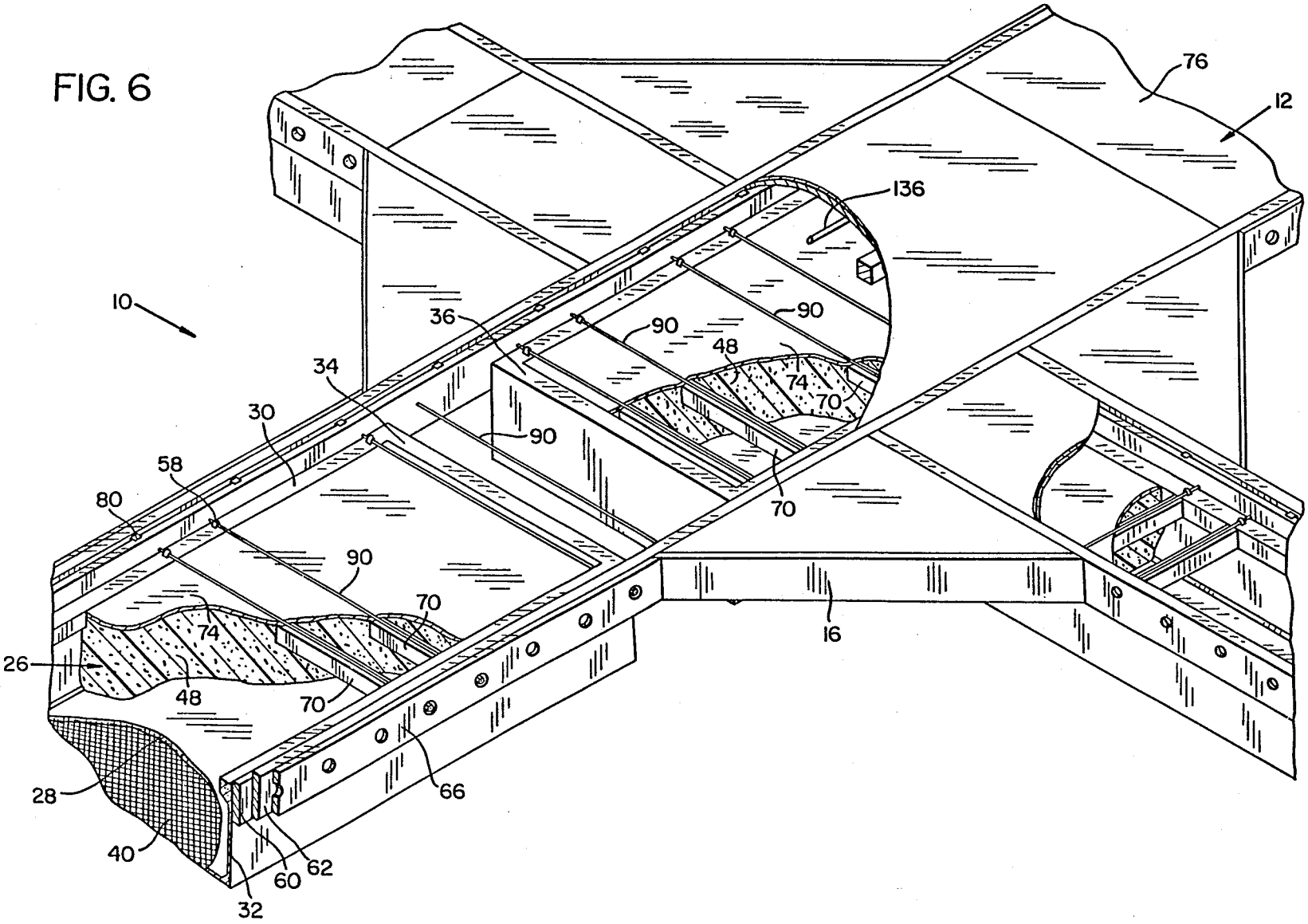
FIG. 6 is a fragmentary perspective view of a main walk portion of the dock of FIG. 1 with finger float sections attached, portions of the deck being cut away to show the arrangement of parts below the deck.
Figure 7:
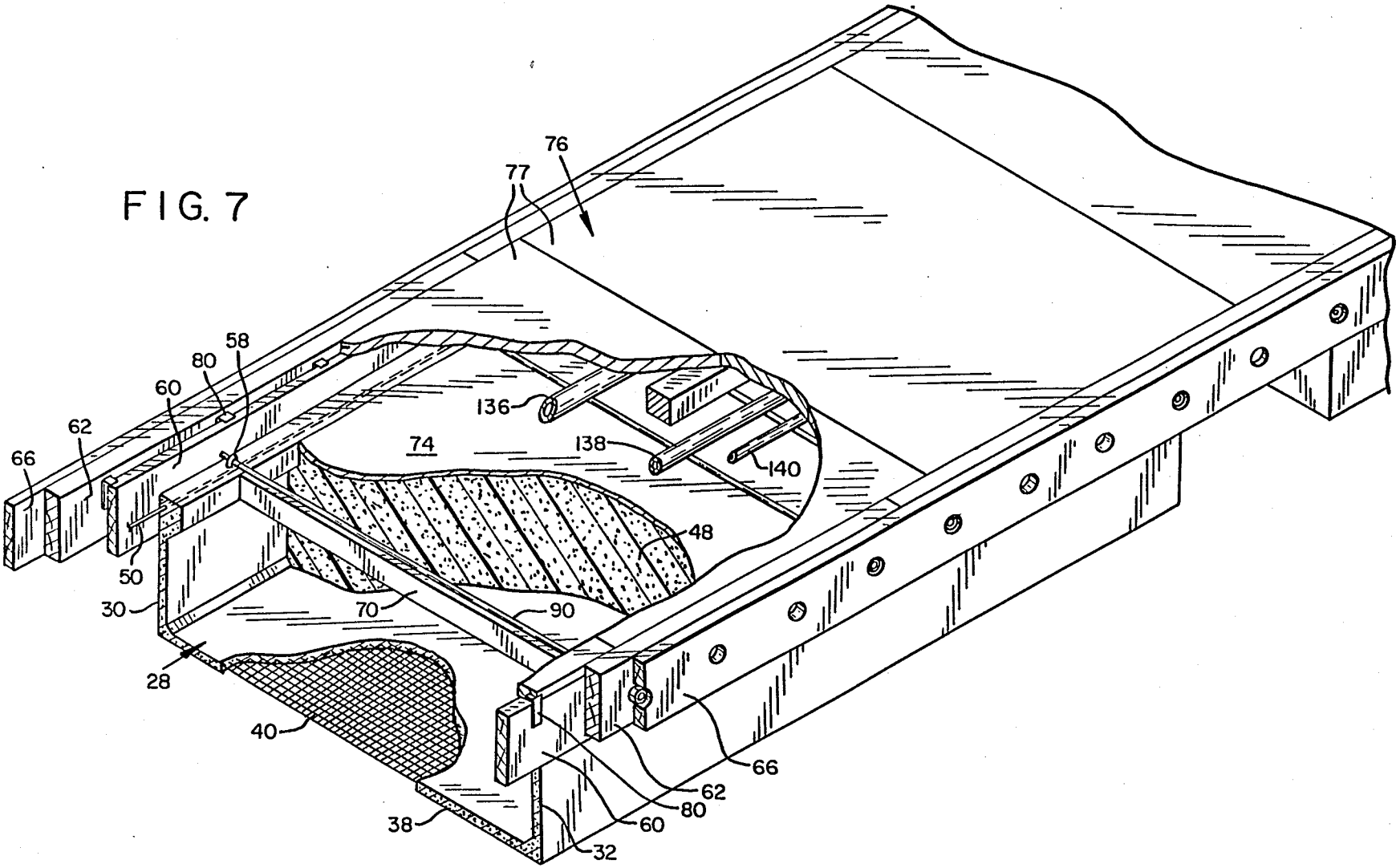
FIG. 7 is an enlarged, fragmentary perspective view of a main walk portion of the deck shown in FIG. 6, portions of the deck being cut away.

As shown in FIGS. 3 and 6, the main walk section 12 includes a plurality of float modules 26 spaced longitudinally along the dock 10, each float module comprising a rectangular tub-like, hollow concrete container 28 having opposing longitudinal sidewalls 30, 32, opposing transverse sidewalls 34, 36, and a bottom 38. The containers 28 are preferably reinforced by embedding a reinforcing mesh 40 (FIG. 6) therein, such as polypropylene or similar material inert to the corrosive attack of a marine environment. The topmost portions of each sidewall 30, 32 are enlarged to form a pair of elongated, opposing protuberances 42, 44 each having a sloping, inwardly and downwardly facing surface 46. Similar protuberances (not shown) are provided along sidewalls 34, 36. Each container 28 contains a buoyant material 48 such as, for example, one pound per cubic foot expanded polystyrene foam which fills the container.

As best seen in FIG. 5, a reinforcing bar 50 extends around container 28 through the protuberances 42, 44 of each of the float modules 26 and provides a support for a plurality of lifting loop elements 52 which protrude upwardly above the top surface of the protuberances 42, 44. As shown in FIG. 5, the lifting loop elements 52 comprise metal rods bent into an L-shape, with one leg 54 disposed horizontally below the bar 50 and the other leg 56 projecting vertically upwardly from the bar 50. The reinforcing bar 50 may be spot welded to the apex of a loop element 52 where the two legs of the L join. The upper end of a leg 56 extending above the upper surface of the walls 30, 32 is bent into a semicircular shape or loop 58, see FIG. 6, the plane of each loop 58 being parallel to the longitudinal axis of dock 10. The loops 58 provide a means for attachment of lifting hooks of a crane to facilitate movement of the containers and have a further function to be described. The loops 58 are arranged in opposed pairs, there being one pair adjacent each end of a container 28 and two pairs adjacent the center.

As shown in FIG. 5, the polypropylene mesh 40 is preferably looped around the reinforcing bar 50. Typically, a container 28 of a main walk section 12 is eight feet long, five feet in width and twenty inches deep. A container in a finger section is of similar length and depth but has a width of two and one-half feet.

As can best be seen in FIG. 6, in an assembled dock the float modules 26 are spaced apart from one another, usually by a distance of one to two feet. This space between the modules 26 provides a flow space through which debris may pass, enhances the wave transparency of the dock 10, and prevents damaging contact between adjacent members during stormy conditions.

A pair of opposing elongated wooden wales extend along the opposing longitudinal sides 18, 20 of the main walk section 12. Each of the pair of wales includes an inner wale 60 which may comprise a series of 2×10's, and an outer wale 62, which may, for example, comprise a series of 3×10's. The wales are preferably pressure treated with a preservative. The 2×10's and 3×10's of the wales overlap each other and the float modules, as indicated in FIG. 6. The wale 60 is placed lower on the sidewalls 30, 32 than is the wale 62. This arrangement of wales 60, 62 provides an upwardly facing ledge 64 (FIG. 5) for a purpose described later.

A rub board 66 covers the outside face of outer wale 62 to provide a protective member against which moored boats may bump. The rub board 66 is secured to the outer wale 62 by suitable fasteners, such as nails 68 (FIG. 5).

Referring particularly to FIGS. 3, 5, and 6, a series of parallel, transverse, wood or concrete compression beams 70 extend between opposing walls 30, 32 of each container 28, a beam being positioned in alignment with each opposing pair of lifting loops 58. In the described embodiment, four wood beams 70 extend between the protuberances 42, 44 of walls 30, 32 within notches provided in the buoyant material 48 as shown in FIG. 6. Preferably the space between the sloping protuberant surface 46 and the ends of each beam is filled with concrete 72 so as to provide and extend the area of contact between the beam ends and the walls. A covering 74 of suitable material, such as fiber cement, may be placed over the tops of the beams 70 to close the top of the container and provide a protective covering for the beams 70 and buoyant material 48.

A pedestrian deck 76 extends the length of the dock sections 12, 14. The deck 76 may comprise any suitable element such as planking or panels formed of planks or, as illustrated, a plurality of adjacent plywood panels 77 having a nonskid top surface layer 78 (FIG. 5) of fiber cement or similar material. The opposite side edges of the panels are supported on the ledges 64 previously described and snugly engage the outer wales 62, as best shown in FIG. 5. The deck panels 77 may simply be laid upon the ledge 64 and clamped in place by the engagement of the wales 62 therewith when the dock is fully assembled. However, where the dock 10 may be subjected to strong wave action, preferably the panels are held in place by a plurality of L-shaped brackets 80, each of which has a flat, horizontal first leg 82 and a vertical second leg 84. The legs 82 extend into a kerf 86 formed in the side edges of the panels. The legs 84 extend downwardly along the outer face of the inner wale 60 so that they are clamped thereagainst by the outer wale 62. The leg 84 is formed with a plurality of struck-out teeth 88 which extend into the wale 60. Thus, the deck panels 77 are firmly held in position in spaced relationship above the containers 28. Preferably the deck panels 77 are sized so as to be frictionally and compressively engaged by the opposite wales 62 when the units are assembled.

A nailer board 92 is preferably positioned beneath deck 76 on the interior face of each wale 60. In assembly, the nailer boards 92 are secured with a marine adhesive to the wales 60 before the latter are mounted to the container 28. Then nails 94 are driven through the board 92 and into the bottom of a deck panel 77 as shown in FIG. 5. Thereafter, the assembled panels 77 and wales 60 are positioned on the containers 28 and secured thereto as described below. The deck 76 is, therefore, secured to its underlying structure completely from below, without the necessity of piercing deck 76 from above with nails or other mechanical fastener. Fasteners which penetrate a deck from above tend to work themselves above the deck surface under the influence of torsional stresses caused by wave action and other environmental influences. The protruding fasteners are undesirable since they may cause a pedestrian to trip or cause injury to the foot of dock users. The structure of the application avoids this problem since the decking is either secured in place simply by clamping it between the opposite wales or by using supplemental fasteners which are entirely below the deck surface.

Extending transversely of the modules 26, one above each beam 70, are compression rods 90. The rods 90 extend through opposite lifting loops 58, through the wales 60, 62, and into openings 96 in the rub boards 66. Nuts 98 are threaded onto the cooperatively threaded ends of the rods 90 and bear against washers 100, which engage the wales 62. The nuts 98 are torqued to cause a compression force to be exerted on the opposing wales 60, 62 which force is transmitted through the container sidewalls 30, 32 to the deck 76, and compression beams 70, thereby creating a box beam structure extending the length of main walk section 12. As will be apparent, the loops 58 anchor the wales 60, 62 and the deck 76 securely to the float modules 26.

An intermediate support beam 102 (FIG. 3) extends longitudinally of main walk section 12 below deck 76 and above rods 90 to provide intermediate support for deck 76. The beam 102 provides additional support for the middle portion of deck 76 to prevent bending or bowing in response to loads on the deck.

A second embodiment of a main walk section **12*a* is shown in FIG. 4. This embodiment differs from that shown in FIG. 3 by provision of identical, side-by-side float modules 26*a*, 26*a*'each substantially identical to float module 26 of FIG. 3 but of a narrower width. Parts in FIG. 4 that correspond to similar parts in FIG. 3** have been given like numerals but are differentiated therefrom by addition of the letter "a" to each numeral.

The embodiment of FIG. 4 has an intermediate wale 108 extending longitudinally of an assembled dock 10 midway between the opposite side wales **60*a* and downwardly between the float modules 26*a* and 26*a*'. Compression rods 90*a* extend across both float modules 26*a* and 26*a*' and are secured in place and loaded similarly to the rods 90. Thus, sidewalls 30*a*, 32*a* of the modules 26*a*, 26*a*' clamp the wale 108** between them.

Referring now to FIGS. 1 and 2, each finger section 14 comprises a plurality of longitudinally spaced, float modules 110 each comprised of a hollow container 112 of approximately one-half the width of a container 28. Each has opposing sidewalls 114, 116 and a bottom 118. Each float module 110 contains buoyant material 120, such as the polystyrene foam 48. A plurality of compression beams 122 extend between opposing sidewalls 114, 116, and a deck 124 is held in spaced relationship above beams 122 by opposing, longitudinally extending wooden wales 125 comprising a pair of overlapping inner and outer wale members 126, 127, respectively, arranged similarly to wales 60, 62 along each sidewall 114, 116. The panels of the deck 124 are preferably secured in position, as shown in FIG. 5. A rub board 128 extends longitudinally along each of the opposing pair of wales 125, and compression rods 130 extend through aligned bores in wale members 126, 127 and rub board 128, with a nut 132 threaded around external threads at opposite ends of rod 130. Nuts 132 are tightened to compress wales 125 into compressing relationship against sidewalls 114, 116, thereby creating a box beam out of the combination of beams 122, deck 124, and wales 125.

A suitable arrangement for securing a finger 14 to the main walk section is shown in FIG. 8. The struts 16 are suitably bolted to the main section 12 and fingers 14, respectively. Compression rods **90, 90*a* of extended length, or additional compression rods may be added to clamp the struts, as shown in FIG. 8. In addition, angle plates 17 are bolted to the main section and finger section on each side of the latter, again using compression rods 90, 90*a* or added rods as may be desired or necessary. In this manner, the sections 12, 14** are held in fixed perpendicular relationship to one another.

The box beam thus created in a main dock section 12 by compressively loading the containers 28, beams 70, deck 76, and wales 60, 62 creates a rigid structure that floats without substantial bending in response to environmental influences. The interior of this box beam provides a passageway 134 through utility lines, such as electrical and telephone lines and water, can be positioned, as indicated at 136, 138 and 140 in FIG. 7. A particular advantage of the structure wherein the deck 76 is simply frictionally held in place between the opposing wales is that the utility lines may be positioned in the utility passageway from the top before the deck is laid in place. Moreover, access to the passageway for service of the utilities is easily accomplished by simply loosening the nuts 98 on the compression rods to free the decking so it can be lifted off.

A box beam structure is also created in each of finger float sections 14 by compressively loading containers 112, beams 122, deck 124, and wales 125. A passageway 142 is provided between deck 124 and rods 130, and this area can also be used as a utility conduit passageway.

Conventional means (not shown) may be provided to secure the dock 10 to pilings or other structures.

An advantage in the positioning of the compression rods above the concrete walls of the float modules is that this arrangement makes practical reconstruction of existing, compressively loaded docks such as those shown in U.S. Pat. No. 4,353,320. In such reconstruction float modules, such as shown in that patent, would have their existing wales and compression rods removed. Opposing wales would then be fixed along the sides of the modules, with compression rods extending between the wales above the top surface of the float module as shown and described therein. The concrete top of the existing float shown in that patent would provide a compression beam analogous to beam 70 in FIG. 3. In this manner, a box beam structure will be created by compressive loading of the deck, wales and the concrete tops of the existing float.

The present invention enjoys several additional advantages unknown in the prior art. For example, the deck 76 is spaced above float module 26 a greater distance, whereby greater freeboard is provided for the dock 10. Since this freeboard is a result of the elevated deck structure with a utility passageway beneath the deck, float modules 26 can be smaller and lighter than in the prior art where additional freeboard could only be gained by making the concrete container taller. The lighter weight and smaller size of the containers 28 are of particular advantage during land transportation of the float modules to their ultimate destination since more containers 28 can be stacked on top of one another in a given amount of space, and transportation costs are lessened by the lighter weight of containers.

Lifting loops 58 also increase efficiency of transportation and assembly of the dock. Prior art float modules had to be moved with forklifts, making it necessary to load the float modules on a truck with several inches of clear space between the top of one member and the bottom of another to make room for the forks. The lifting loops 58 of the present invention obviate the need for a clear space between members by simply providing a place for hooking the member from above and moving it without a forklift. Elimination of fork spaces allows more floats to be stacked on top of one another upon a truck bed, especially since the space occupied by loops 58 is much less than that required for a forklift clear space. A one inch thick sheet of compressible foam padding between stacked members is sufficient to protect them from damaging each other.

PLASTIC MODULE EMBODIMENT

Another embodiment of the floating dock of the invention is shown in FIGS. 9–12. In this embodiment, elongated floating dock 200 includes a main walk section 202 with a plurality of finger float sections 204 extending transversely thereto. Finger sections 204 are attached to the main walk section 202 by a plurality of struts 205 and brackets 207, similar to those described in connection with struts 16 and angle plates 17 (FIG. 8) of the first embodiment above.

Figure 11:
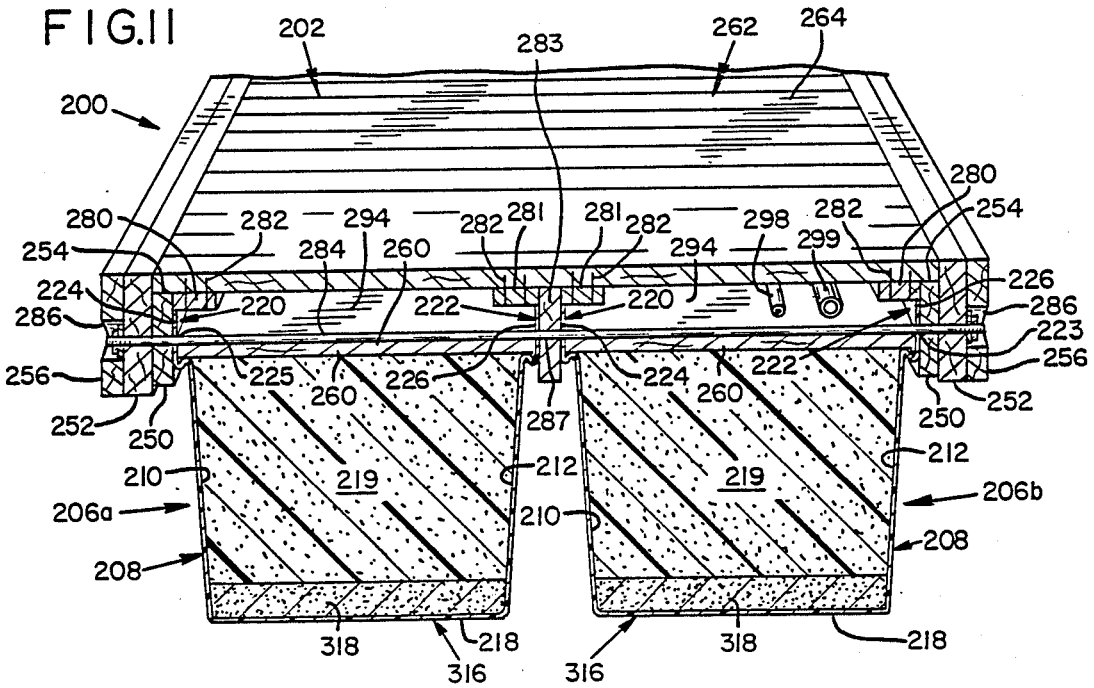
FIG. 11 is a cross-sectional view taken along section line 11—11 of FIG. 9.

As shown in FIG. 11, the main walk section 202 includes a plurality of identical, side-by-side float modules **206*a*, 206*b* spaced longitudinally along the dock 200, each float module comprising a rectangular tub-like, hollow plastic container 208 having opposing longitudinal sidewalls 210, 212, opposing transverse sidewalls 214, 216 (FIG. 9), a bottom 218 (FIG. 11), and an open top. The containers 208 are typically made of a high density polyethylene, low linear density polyethylene, or cross-linked polyethylene. The walls 210, 212 of the container 208 are slightly sloped such that the width of the container increases slightly from the bottom 218 to the open top to facilitate stacking for shipping and to give greater flotation stability. A buoyant material, such as expanded plastic 219**, substantially fills each module to provide positive buoyancy.

A flexural flange 220 extends upwardly from sidewall 210 of container 208, while an opposing flexural flange 222 extends upwardly from sidewall 212. A plurality of holes 223 (see especially FIG. 12) are provided through flange 222, and a corresponding plurality of opposing holes 225 (FIGS. 10 and 11) are provided through opposing flange 220. Flanges 220, 222 provide a pair of opposing load distributing flexural flanges for a purpose described below.

Figure 9:
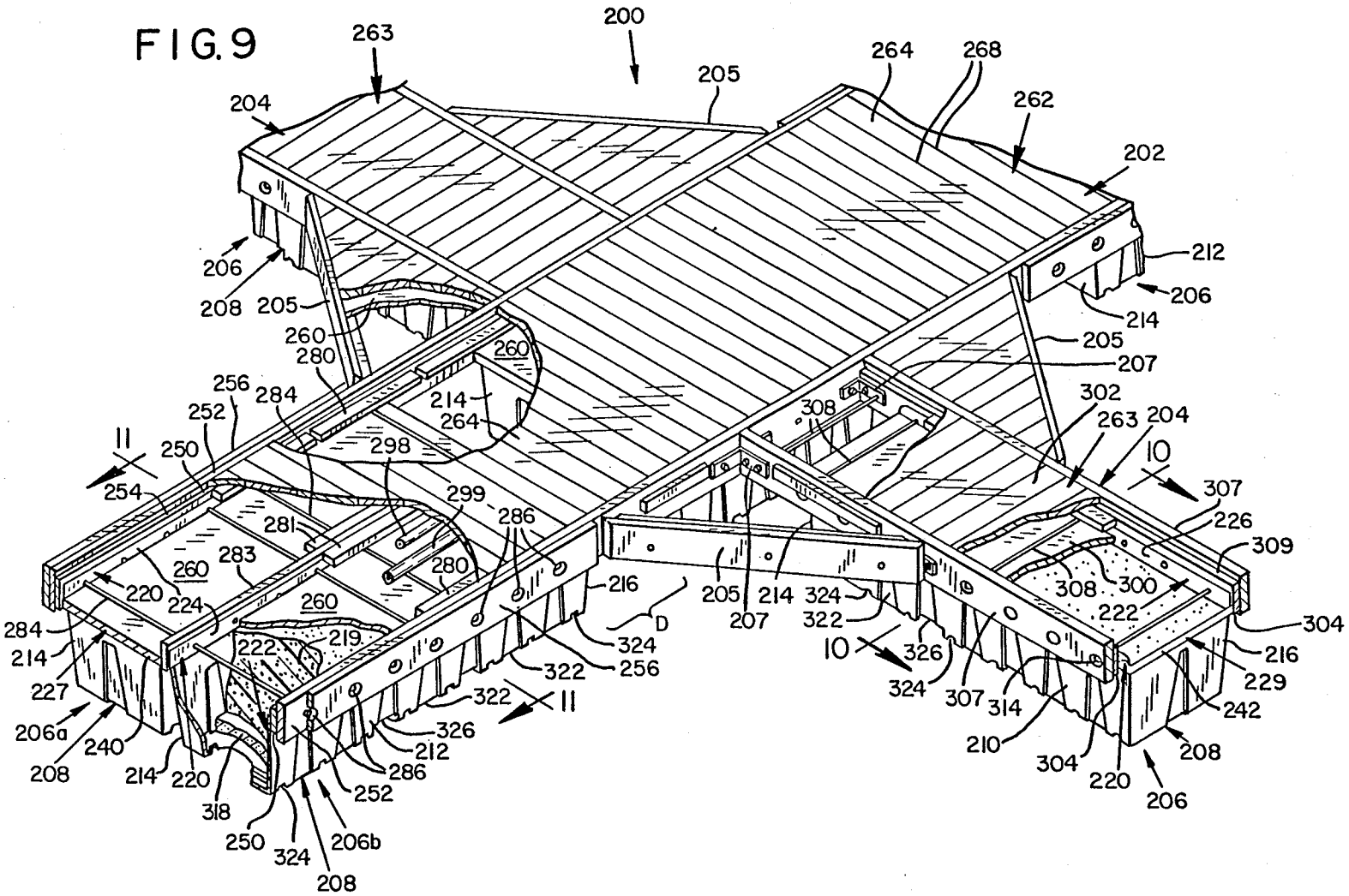
FIG. 9 is a fragmentary perspective view of a third embodiment of the dock having plastic float modules.

As best seen in FIG. 9, each transverse sidewall 214 of the container 208 has an upwardly extending flange 227, and each transverse sidewall 216 has an opposing upwardly extending flange 229. The flanges 227, 229 are similar to the flanges 220, 222 except that the flanges 227, 229 only extend up to the level of the bottom of holes 223, 225 in the flanges 220, 222.

Figure 12:
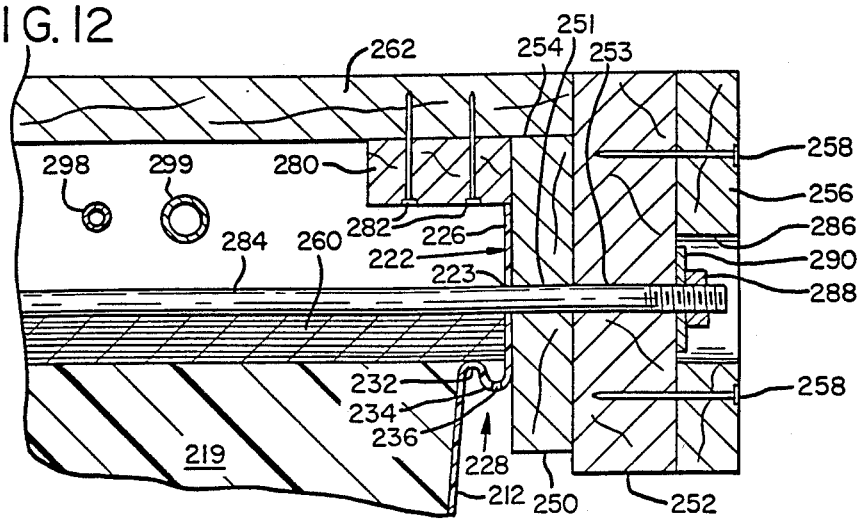
FIG. 12 is an enlarged, fragmentary, sectional view of a top corner of the dock shown in FIG. 11.

Each flange 220, 222 along the sidewalls 210, 212 includes an upwardly extending lip 224, 226 connected to its respective sidewall 210, 212 by an S-shaped member 228 (FIG. 12). Each member 228 includes a downwardly curved shoulder 232 connected to sidewall 210 or 212 and an upwardly curved shoulder 234 connected to lip 224 or 226. In the embodiment shown in FIG. 12, shoulder 234 is provided with vent holes 236 through which water that enters the module at the juncture between the flange and the wale 250 can be vented to the exterior of the module. Vent holes 236 prevent an accumulation of water within container 208 that can cause loss of freeboard or uneven flotation of the dock.

Each flange 227, 229 along the transverse sidewalls 214, 216 includes a lip 240, 242 which extends upwardly to the level of the bottom of the holes 223, 225 and is connected to its respective sidewall 214, 216 by an S-shaped member (not shown) similar to the S-shaped member 228.

As can best be seen in FIG. 9, in an assembled dock the pairs of float modules **206*a*, 206*b* are longitudinally spaced apart from the adjacent pair of float modules, usually by a distance D of one to two feet. This space between the pairs of modules 206 provides a flow space through which debris may pass, enhances the wave transparency of the dock 200** and prevents damaging contact between adjacent members during stormy conditions, and permits placement of piling internal to the wale system.

A pair of opposing elongated wooden wales extend along the opposing longitudinal sides of main walk section 202. Each of the pair of wales includes an inner wale 250, which may comprise a series of 2×8's and an outer wale 252, which may, for example, comprise a series of 3×10's. The 2×8's and 3×10's of the wales 250, 252 overlap each other and the float modules 206 in main walk section 202, as indicated in FIG. 9. Since the wale 250 is not as high as the wale 252, the wales 250, 252 provide an upwardly facing ledge 254 (FIG. 12) for a purpose described later. A plurality of holes 251 are provided through the wale 250, and a corresponding plurality of holes 253 are provided through the wale 252, the holes 251, 253 being aligned with each other and with the holes 223, 225 in flanges 220, 222 when the wales are assembled as shown in FIG. 12.

A rub board 256 covers the outside face of outer wale 252 to provide a protective member against which moored boats may bump. The rub board 256 is secured to the outer wale 252 by nails 258. A plurality of holes 286 through the rub board 256 are aligned with the holes 251, 253, but the hole 286 is of a larger diameter for accommodating a nut 288 and washer 290 described later.

A panel of plywood 260 extends across and covers the open top of each container 208 in the main walk section 202. As best seen in FIG. 12, opposing longitudinal edges of the panel 260 contact the flanges 220, 222 and rest on top of the downwardly curved shoulder 232 with a vertical face of each edge of the panel 260 fitting tightly against the lips 224, 226. FIG. 9 illustrates that opposing transverse edges of the panel 260 contact the flanges 227, 229 and rest on top of the downwardly curved shoulder (not shown) that connects the transverse sidewalls 214, 216 to the lips 240, 242.

A pedestrian deck 262 extends the length of dock section 202, and a pedestrian deck 263 extends the length of the finger section 204. The deck 262 may comprise any suitable elements such as a plurality of adjacent 2×6 planks 264, as illustrated. The opposite side edges of the panels 264 are supported on the ledges 254 previously described and snugly engage the outer wales 252 as best shown in FIG. 12. The deck panels 264 are laid upon the ledge 254 and clamped in place by the engagement of the wales therewith when the dock is fully assembled and under transverse compression, as described below. The deck panels 264 are sized to be frictionally and compressively engaged by the opposite wales 252 when the units are assembled.

The deck 263 on the finger float section 204 is similar to the deck 262; yet its width is narrower so that its edges fit in tight frictional engagement against the wales of the narrower finger sections 204.

An intermediate wale 283 (FIGS. 9 and 11) in the main walk section 202 extends longitudinally of the section 202 between rows of the modules 206*a*, 206*b* below the deck 262 to provide intermediate support for the deck 262. A plurality of holes 287 are provided in the wale 283 through which compression rods 284 (described below) extend. The wale 283 provides additional support for the middle portion of the deck 262, the wale being frictionally engaged between flanges 220, 222 when the dock is assembled.

A nailer board 280 is preferably positioned beneath the deck 262 on the interior face of each wale 250. Another nailer board 281 is positioned beneath the deck on both vertical faces of the intermediate wale 283. In assembly, the nailer boards 280, 281 are secured with a marine adhesive and/or nails to the underside of a panel 264 before the panel is mounted on the container 208 between the wales of the main walk section 202. Thereafter, the assembled panels 264 and wales 250, 283 are positioned on the containers 208 of the main walk section 202 and secured thereto as described below. The deck 262 is, therefore, secured to its underlying structure completely from below without the necessity of piercing the deck 262 from above with nails or other mechanical fasteners.

A plurality of compression rods 284 extend transversely of the modules 206 in the main walk section 202. The rods 284 extend through an opposing pairs of openings 223, 225 in flanges 220, 222, as well as through aligned holes 251, 253, 287 in the wales 250, 252, 283 and into aligned openings 286 in the rub boards 256. Nuts 288 are threaded onto the cooperatively threaded ends of each rod 284 and bear against washers 290, which engage the wales 252. The nuts 288 are torqued to exert a compression force on the opposing wales 250, 252, which force is in turn exerted on the deck 262, and through flanges 220, 222 on the panel 260. Compressively loading the panel 260 and the deck 262 creates a box beam structure which extends the length of the main walk section 202. Compression of the wales 250, 252, 283 against the flanges 220, 222 frictionally engages the plastic modules 206 to hold them in place below the deck 262.

The box beam thus created in a main deck section 202 by compressively loading the containers 208, panel of plywood 260, deck 262 and wales 250, 252, 283 creates a rigid structure that floats without substantial bending in response to environmental influences. The interior of this box beam provides a passageway 294 (FIG. 11) through which utility lines, such as electrical and water lines 298, 299 (FIGS. 9, 10, and 12) can be positioned. Easy access is provided to these utility lines by loosening the nuts 288 on the compression rods 284 to reduce frictional engagement between the edges of the deck panels 264 and the wales 250, and lifting the deck panels off the deck.

Figure 10:
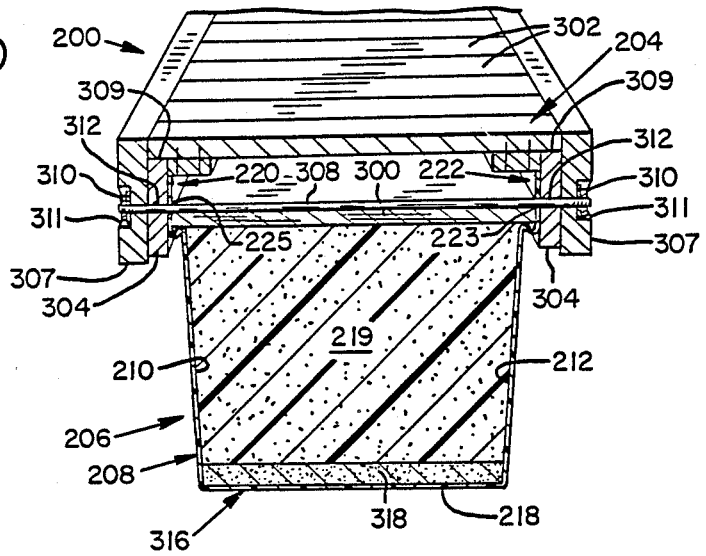
FIG. 10 is a cross-sectional view taken along section line 10—10 of FIG. 9.

Referring now to FIGS. 9 and 10, each finger section 204 comprises a plurality of longitudinally spaced float modules 206 which are identical to the float modules which support the main walk section 202. Unlike in section 202, however, there is only a single line of spaced modules 206 in the section 204, and not the pairs of side-by-side modules 206 used in the wider section 202. A panel of plywood 300 extends between the opposing flanges 220, 222 and rests on the S-shaped connections which interconnect the flange lips 224, 226 to the sidewalls 210, 212. A deck 302 is held in spaced relationship above the panel 300 by a pair of opposing, longitudinally extending wale members 304. A counter board wale 307 is slightly higher than the wale members, such that a ledge 309 is formed on top of each wale member 304 to support the deck 302. Compression rods 308 extend transversely across section 204, through aligned bores 311 in wales 307, and through aligned bores 312 in opposing wale members 304. A nut 314 is threaded around external threads at opposite ends of the rod 308 and tightened to compress wales 304, 307 against the flanges 220, 222, thereby creating a box beam out of the combination of panel 300, deck 302, and wales 304, 307.

A layer of heavy ballast material, such as sand 318, may be placed on the bottom of each module 206 in both the main walk section 202 and finger float section 204. Such ballast lowers the metacentric height of the dock 200 to improve its stability. Because opposing wales frictionally grip the flanges 220, 222 of the modules 206 and spread loads along the length of the modules, the heavy weight of the ballast will not tear the plastic module away from the dock 200. Flexural flanges 220, 222 also prevent direct transmission of vertical tensions from the walls 210, 212 of the modules to the compression rods 284, 308. It is important to avoid such vertical tensions since they could tear the plastic flanges 220, 222, especially at holes 223, 225.

In an alternate embodiment, the layer of heavy ballast material can be replaced by water ballast. In such an embodiment, one or more small holes are drilled in or near the bottom of each module 206, for example at 316 (FIGS. 10 and 11). When the assembled dock 200 is then placed in a body of water, the water enters the module and occupies the area between the foam and the wales of the module until the water reaches a level inside container 208 which is the same as the level of water outside the container. Providing a water ballast in this manner avoids the necessity of adding sand ballast during assembly and overcomes problems of uneven dock flotation caused by adding too much or too little ballast to any module. A water ballast also eliminates the potential problem of structural fatigue of the module from the weight of a heavy ballast since the weight of water ballast is the same as the medium which surrounds the dock. Assembly of the dock is also facilitated since the module does not become heavier until it is placed in water. Disassembly is similarly facilitated since the module becomes lighter as it is lifted and water drains out of it.

Finally, a water ballast eliminates problems caused by water seepage into a dry ballast material. If water seeps into a sand ballasted module, that module will become heavier than others and will float lower than the remainder of the modules in the dock. When water seeps into a water ballasted module, however, some water will leave the interior of the module through the hole at 316 since the level of water within the module will always remain the same as the level of water outside the module.

As best seen in FIG. 9, the sidewalls 210, 212 of each module 306 are molded to provide a series of external corrugations comprised of indentations 322. The bottom 218 is similarly molded to form a series of small indentations 324 and larger indentations 326. The indentations 322, 324 fit within one another when modules are stacked during transportation, thereby providing easier stackability of the modules. Larger indentations 326 also stack within one another and are of a proper shape and dimension to serve as forklift points into which the prong of a forklift can fit.

Having illustrated and described the principles of the invention in several preferred embodiments, it should be apparent to those skilled in the art that the invention can be modified in arrangement and detail without departing from such principles. I claim all modifications coming within the spirit and scope of the following claims.

I claim:

1. A float module for floating docks, said float module comprising:

a hollow open top container having a single contiguous bottom wall, end walls and sidewalls which together define a floatation chamber, said container containing a buoyant material to provide positive buoyancy to said container when water is admitted thereto;

a pair of opposing, load distributing flexural flanges integral with and extending upwardly one from each sidewall of said container; and a compression resistant panel extending across the open top of said container and abutting said opposing flanges;

said container walls having at least one open hole therethrough at a location such that it will be positioned beneath the surface of the water when the float module is in operative floating position in a body of water and through which hole water can freely enter and leave said floatation chamber to ballast said module.

2. The float module of claim 1 wherein each said flexural flange comprises an upwardly extending lip connected to the container sidewall by an S-shaped member comprising a downwardly curved shoulder connected to said sidewall and an upwardly curved shoulder connected to said upwardly extending lip.

3. A floating dock comprising:

a plurality of aligned float modules each comprising a container having a single contiguous bottom wall, end walls and sidewalls and containing a buoyant material to provide positive buoyancy to said container when water is admitted thereto;

deck means for providing a continuous walkway over said plurality of float modules; and water ballast means for maintaining a water ballast level within each of said containers at substantially the same level as the water level outside a said container during use of the container as part of a floating dock in water comprising an open water entry hole in a wall in each of said containers below a water level line at which said container is designed to float and through which hole water may freely enter and leave each said container.

* * * * *